US005603410A

United States Patent [19]

Kara

[11] Patent Number: 5,603,410

[45] Date of Patent: Feb. 18, 1997

[54] MEMORABILIA DISPLAY CASE

[75] Inventor: Salim G. Kara, Houston, Tex.

[73] Assignee: E-Stamp Corporation, Houston, Tex.

[21] Appl. No.: 505,701

[22] Filed: Jul. 21, 1995

[51] Int. Cl.[6] ..... B65D 5/52

[52] U.S. Cl. ..... 206/769; 206/776; 206/460

[58] Field of Search ..... 206/457, 45.31, 206/45.33, 45.34, 45.14, 45.19, 0.8, 0.83, 0.84, 0.82, 495, 460, 769, 747, 756, 759, 775, 776, 782

[56] References Cited

U.S. PATENT DOCUMENTS 2,916,841 12/1959 Denis ..... 206/457 X
2,931,495 4/1960 Stratton, Jr. ..... 206/45.34 X
3,822,781 7/1994 Braginetz ..... 206/45.34 X
4,936,462 6/1990 Yuen ..... 206/457 X
5,013,278 5/1991 Dixon et al. ..... 206/45.31 X

*Primary Examiner*—Jacob K. Acklin
*Attorney, Agent, or Firm*—Fulbright & Jaworski L.L.P.

[57] ABSTRACT

A display box is arranged to open from the top and includes a transparent lid connected to a bottom with an interior lining. Products to be displayed are then positioned inside the bottom of the box. A mat with cutouts of various shapes and sizes, each customized to reveal only a selected portion of a positioned memorabilia, is then placed on top of these memorabilia as the lid is closed thereby allowing the memorabilia to be viewed through the transparent lid.

9 Claims, 2 Drawing Sheets

MEMORABILIA DISPLAY CASE

TECHNICAL FIELD OF THE INVENTION

This invention relates to a display case designed to house, protect, and exhibit memorabilia and more particularly to such a display case which is loaded from the front and designed to accept display material having different physical characteristics.

BACKGROUND OF THE INVENTION

People collect memorabilia for sentimental, recreational, and pecuniary reasons. Postal stamps, for example, are a popular category for collectors because stamps are inexpensive and readily available. Traditionally, collectors store these stamps in albums, or "stock books," made of heavy cardboard. On each page, strips of transparent material like glassine or plastic form rows of pockets, where the stamps can be stored. To prevent the stamps from shifting, these strips are affixed tightly against each page to form the pockets, so when a stamp is placed inside a pocket, it is held firmly between the glassine strip and the page.

This conventional way of storing postal stamps suffers from several drawbacks. First, because the glassine is permanently pressed against the stamps, there is a risk that over time, the glassine strips could damage the stamps by rubbing print off of them.

In addition, because a single strip of glassine forms a single pocket in each row, the sizes and shapes of the kind of stamps that could be stored in a particular row are limited. Specifically, stamps with unusual shapes (a heart-shaped stamp, for example), would not fit in the album. Accordingly, a need exists for a more flexible way to house and exhibit postal stamp collections.

Also, there is often a need for several different textures, media and physical characteristics, to be involved in any display. Thus, a need exists for a manner of displaying memorabilia, having different shapes and/or thicknesses.

SUMMARY OF THE INVENTION

The problems discussed above have been solved in the present invention, which provides an attractive, flexible way to house, protect and display memorabilia.

In one embodiment of the present invention a transparent lid is connected by hinges to a box with an interior lining. Products such as memorabilia to be displayed are then positioned within the box and attached on a temporary basis to the bottom of the box. A mat with cutouts of various shapes and sizes, each customized to reveal only a selected portion of an object of memorabilia, is then placed on top of these memorabilia so that when the lid is closed the memorabilia can be viewed through the various cutouts.

The memorabilia, in one embodiment, are held in place by a VELCRO closure material, or a similar hook and loop positioning device. The mat, which can be changed when desired in order to accommodate different shapes, has viewing cutouts positioned in the lid between two pieces of transparent material. Three-dimensional memorabilia could be accommodated by changing the shape of the bottom surface to hold the memorabilia.

It is a feature of the present invention to exhibit memorabilia of all sizes and shapes in one single display case.

A further feature of the present invention is to minimize contact between the memorabilia and the display case in order to reduce the risk of damage to the memorabilia.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
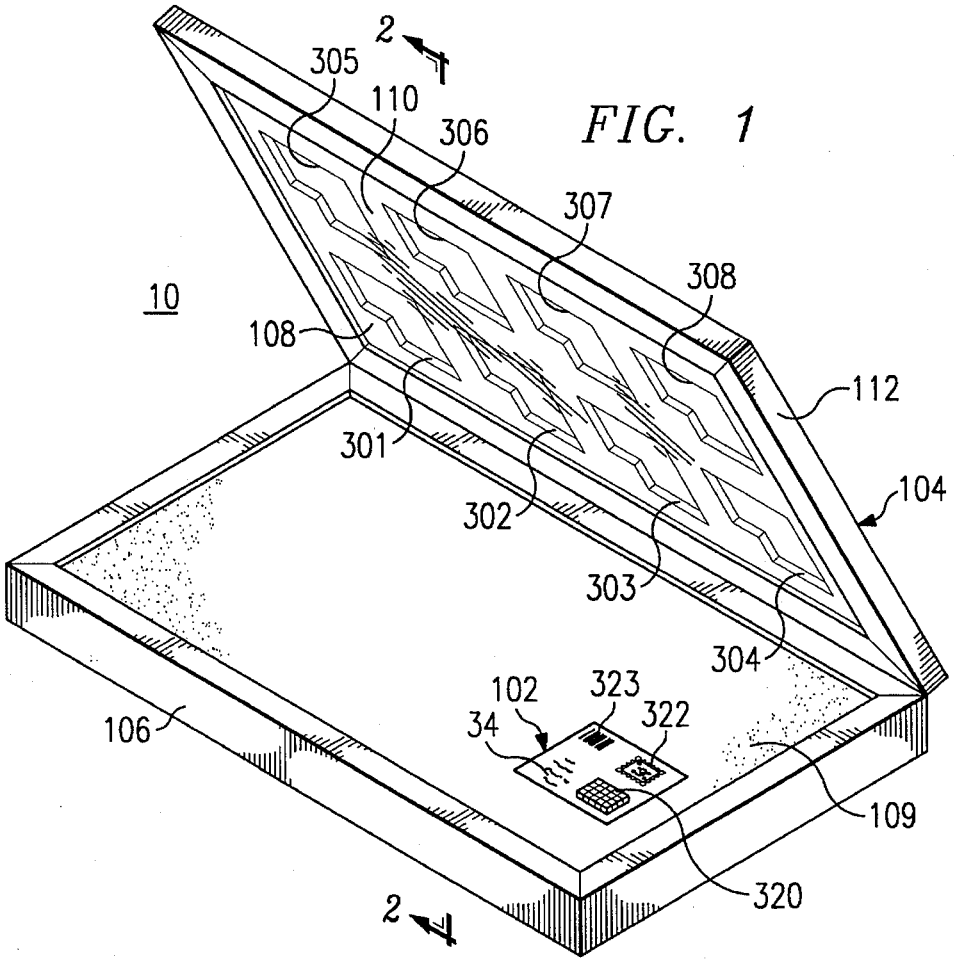
FIG. 1 is an isometric pictorial view showing the display case open with a commemorative display product positioned inside.

FIG. 1 is an isometric pictorial view showing display case 10 open with a commemorative display product 102 positioned inside. In one embodiment, display case 10 consists of three parts: lid 104, box 106, and mat 108. Lid 104 is connected to box 106 by hinges 32, (shown in FIG. 2) so that display case 10 can open and shut with ease. Hinge 32 can be constructed with a spring or other device to maintain the box closed.

Lid 104 is made up of a bottom (inside) transparent panel 110, an insert 108, and a top (outside) panel 30 (seen in FIGS. 2 and 3) all surrounded and held by frame 112. Panels 110 and 30 may be manufactured from different types of transparent materials, in varying weights and thicknesses, such as glass or Plexiglass. Frame 112 is made of a sturdy material capable of holding panels 110 and 30 in place.

Box 106 can come in a variety of shapes and sizes. The interior of box 106 is lined with fabric 109 of any color and texture, such as velvet, designed to make the box more attractive. Fabric 109 can be of loop and hook material to interlock with opposite material on the under surface of product 102. For three-dimensional products, a relief can be constructed into which the product (not shown) can be seated.

Mat 108 in lid 112 is advantageously a one-piece construction that may be manufactured from different types of materials, such as fabric, leather, or paper stock in varying thicknesses, including three-dimensional in relief. Mat 108 contains cutouts of diverse shapes and sizes, each customized to reveal only a portion of a memorabilia and each designed to frame the memorabilia in an eye-catching arrangement. For example, mat 108 of FIG. 1 contains eight L-shaped cutouts 301 through 308. Cutout 308 will fall in juxtaposition with product 102 when lid 104 is closed, allowing product 102 to be viewed through cutout 308.

Figure 2:
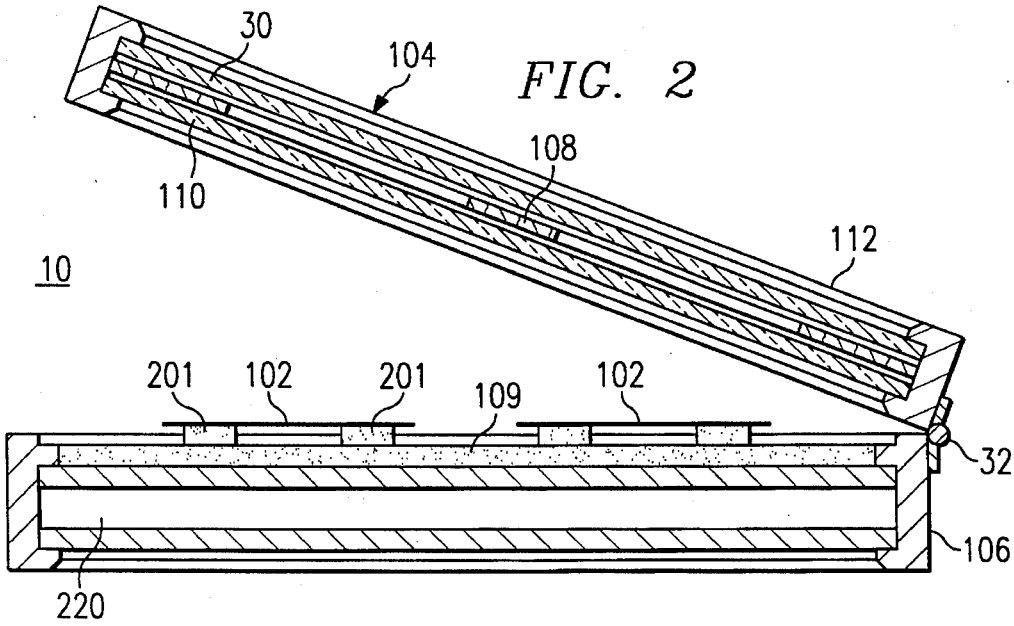
FIG. 2 is a sectional view taken through section 2—2 of FIG. 1.

As shown in FIG. 2, commemorative product 102 can be attached to backing 201, and then mounted to the bottom surface 109 of box 106 to prevent it from shifting.

The cutaway view seen in FIG. 2 shows mat 108 in lid 104 positioned between outer sheet 30 and inner sheet 110 of transparent material. Positioned in the bottom portion 106 of commemorative display 10 is product 102 having loop sections 201 which fasten to material 109. Of course, the user can position product 102 in any manner along pad 109. The top mat 108 would then have cutouts corresponding to each of the positioned materials. The user can, as shown, have all of the cutouts prepunched or could have the number of cutouts matching precisely the number of commemorative products 102 displayed. This can be accomplished by either changing top mat 108 when new material is to be displayed or by punching out prescored cutouts, which prior to being punched out would appear to be solid to a viewer.

Figure 3:
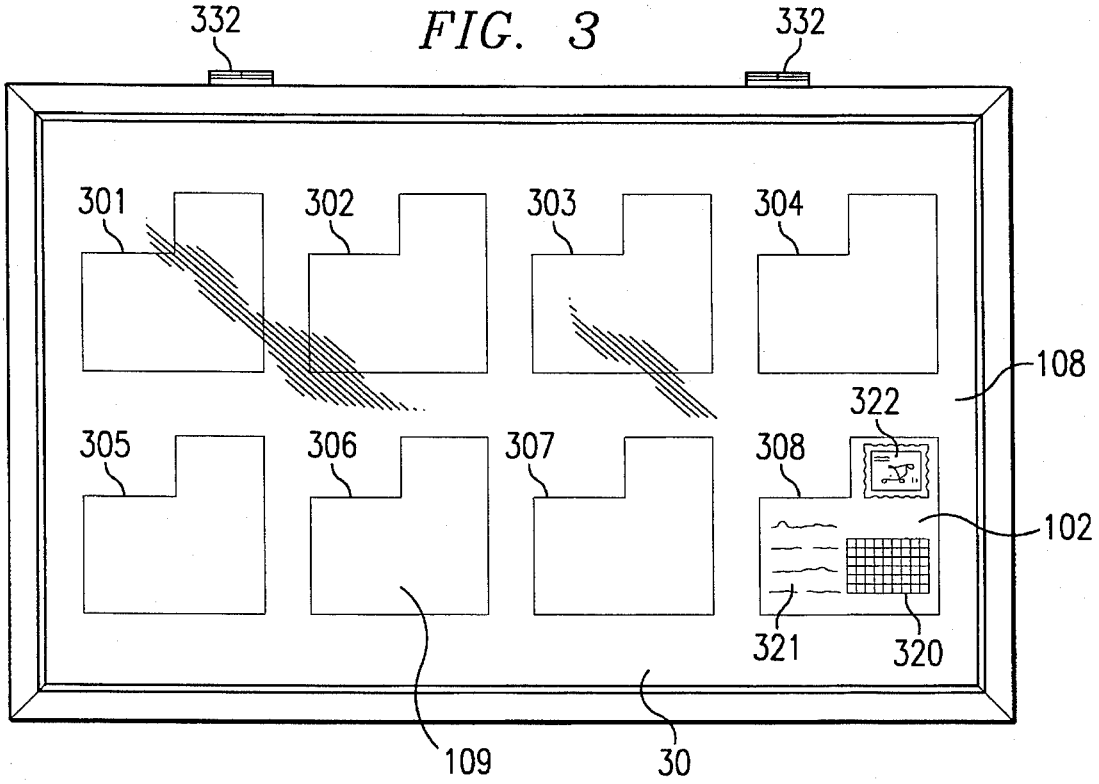
FIG. 3 shows the display case having eight openings through which material to be displayed can be seen.

Turning now to FIG. 3, there is shown a top view of the display case closed with prepunched out L-shaped cutouts with only one cutout, namely cutout 308, through which a viewer would see a commemorative product 102. The other cutouts would show blank base material 109. Commemorative product 102 is shown having three distinct sections 320, 321 and 322 which are seen through cutout 308 of mat 108. As can be seen in FIG. 1, commemorative product 102 has a fourth section 323 which is not visible to a viewer when the top is closed. Note that the cutouts are designed to show only a portion of the product. This is, of course, optional with the users.

Figure 4:
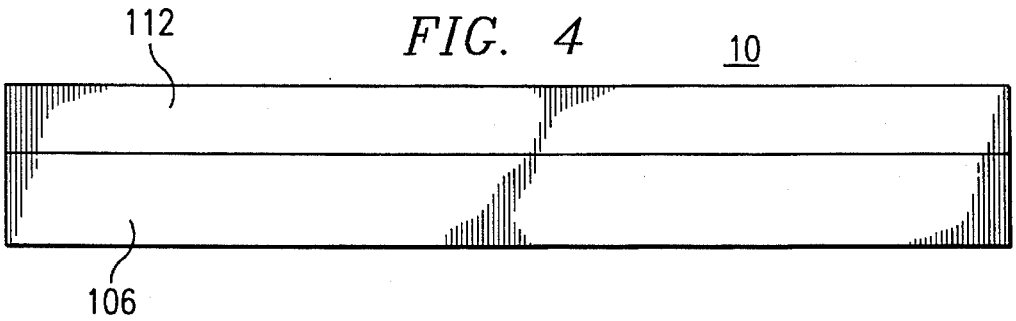
FIG. 4 is a front view of the display case.

FIG. 4 shows a front view of box 10 closed.

Figure 5:
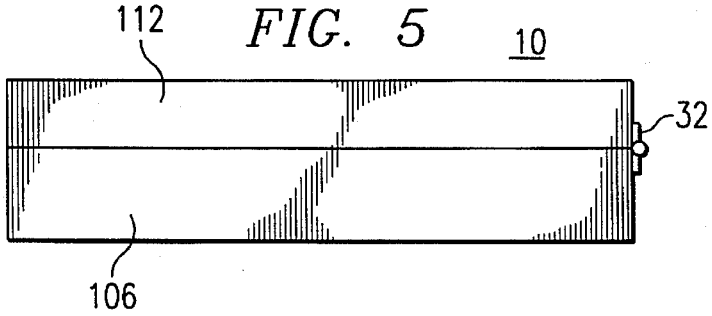
FIG. 5 is a right projection of FIG. 3.

FIG. 5 shows a right side view of box 10 closed with hinge 32 on the right. Of course, any type of hinge can be utilized. The top and bottom sections can be held together with the mechanical pressure of a spring-type hinge or with magnetic pressure built into the box with magnets being in the top and by bottom surface (not shown). Mechanical locks, including a key lock, could be positioned if desired to prevent tampering.

The box material can be any conventional material or, for added security it could be case hardened steel with transparent material that can not be broken easily so that a user can display valuable products without fear of loss.

Although the present invention and its advantages have been described in detail, it should be understood that various changes, substitutions and alterations can be made herein without departing from the spirit and scope of the invention as defined by the appended claims.

What is claimed is:

1. A display case in combination with memorabilia selected from the group consisting of stamps, post cards, envelopes and said display case comprising:

a box having a bottom;

a lid sized to movably mate with said bottom, said lid having a first transparent panel in a top surface and a second transparent panel;

a liner lining said bottom of said box, said liner adapted to hold memorabilia; and a mat disposed between said first transparent panel and said second transparent panel, said mat having at least one cutout shaped to reveal a selected portion of said memorabilia through said first transparent panel when said lid is fit on said bottom.

2. The display case of claim 1, wherein said lid further comprises:

a frame surrounding said first and second transparent panels for holding said transparent panels and said mat.

3. The display case of claim 1, wherein one edge of said lid is movably attached to a mating edge of said box bottom.

4. The display case of claim 3, wherein said lid is attached to said box bottom by a plurality of spring-loaded hinges, said hinges forceably holding said lid and said bottom in mated relationship.

5. The display case of claim 3, further including:

means for positioning said lid in an open position with respect to said bottom so as to allow the addition or removal of selected ones of said memorabilia.

6. The display case of claim 1, further comprising:

Means for adapting said at least one cutout to a selected size and shape as desired in order to display held ones of said memorabilia.

7. The display case of claim 1, wherein said liner has at least one relief position for accepting memorabilia to be held, said relief position adapted to match the three-dimensional shape of said memorabilia.

8. A display case for displaying a commemorative product, comprising:

a box having a side, a top, and a bottom;

a base material lining the bottom of the box; and a lid movably connected to the side of the box such that the lid mates with the top of the box, the lid comprising:

a transparent bottom panel;

a transparent top panel;

a mat disposed between the top panel and the bottom panel having at least one cutout to reveal the commemorative product; and a frame surrounding and holding the panels in a close relationship.

9. The display case of claim 8, further comprising:

at least one hinge connecting the lid to the side of the box.

* * * * *